US005116009A

United States Patent [19]

Bayer

[11] Patent Number: 5,116,009

[45] Date of Patent: May 26, 1992

[54] CHANDELIER ORNAMENT SHAFT AND FRAME STRUCTURE

[75] Inventor: Georg Bayer, Plattsburgh, N.Y.

[73] Assignee: A. Schonbek & Co., Inc., Plattsburgh, N.Y.

[21] Appl. No.: 705,920

[22] Filed: May 28, 1991

Related U.S. Application Data

[63] Continuation-in-part of Ser. No. 539,802, Jun. 18, 1990.

[51] Int. Cl.[5] ..... A47H 1/16

[52] U.S. Cl. ..... 248/303; 248/339

[58] Field of Search ..... 248/303, 304, 305, 339, 248/340, 341, 690, 211, 213, 215, 227, 290, 294, 306, 307, 322; 24/598.6, 370

[56] References Cited

U.S. PATENT DOCUMENTS

| | | | |
|---|---|---|---|
| 3,335,991 | 8/1967 | Epple | 248/303 X |
| 3,981,471 | 9/1976 | Currier | 248/690 X |
| 4,068,817 | 1/1978 | Berger | 248/303 X |
| 4,473,383 | 9/1984 | Bonser et al. | 248/306 X |

FOREIGN PATENT DOCUMENTS

| | | |
|---|---|---|
| B302476 | 10/1972 | Austria . |
| 0322910 | 7/1989 | European Pat. Off. . |
| 2525755 | 12/1976 | Fed. Rep. of Germany . |
| U8808409.4 | 9/1988 | Fed. Rep. of Germany . |
| 155955 | 1/1921 | United Kingdom . |

*Primary Examiner*—Ramon O. Ramirez
*Attorney, Agent, or Firm*—Edward R. Gates

[57] ABSTRACT

A chandelier having a frame for supporting ornaments with loop shafts attached thereto provides a frame member having a predetermined thickness and a width between an inner edge and an outer edge. An ornament shaft that terminates in a loop has segments that engage a width defining edges of the frame member while the ornament is positioned in a vertical hanging orientation. The ornament further includes an opening defined by the shaft and a portion of the loop that is constructed and arranged so that the frame member may be engaged with and disengaged from the loop only through the opening and only by first rotating the shaft substantially out of the vertical orientation. The loop is further constructed and arranged so that substantially vertical displacement is prevented. The opening may be defined by an end of the loop and the shaft and the frame member may include one or more formations or indentations having a width less than the width of adjacent sections for supporting the loop.

20 Claims, 8 Drawing Sheets

CHANDELIER ORNAMENT SHAFT AND FRAME STRUCTURE

RELATED APPLICATION

This is a continuation-in-part application of copending U.S. patent application Ser. No. 07/539,802 filed Jun. 18, 1990.

FIELD OF INVENTION

This invention relates to chandelier ornament shafts and frame structures.

BACKGROUND OF THE INVENTION

Chandelier frames are generally constructed to support a plurality of ornaments in the form of crystals, cut glass and the like. A chandelier frame is usually constructed first, and then ornaments, which are formed separately, are later added to the finished frame. In this way, damage to the ornaments during shipping and installation of the chandelier is largely avoided.

Techniques for mounting ornaments upon chandelier frames have varied little over the years. Typically, the frame member of the chandelier includes a plurality of holes through which ornament shafts are placed. The shafts are bent at their unornamented free end, so as to provide a loop for engaging the chandelier frame. A long standing problem with this traditional form of attachment is that the ornaments are easily dislodged from the chandelier frame. Thus, in a chandelier which may have hundreds of hanging ornaments, it is nearly impossible to clean the chandelier without inadvertently dislodging ornaments.

Applicants' copending patent application Ser. No. 07/539,802 illustrates one attempt at solving the foregoing problem. That application discloses unigue, ornament shafts specially designed to prevent dislodgement of the ornaments. A drawback is that these ornament shaft designs are somewhat difficult to install on the chandelier, in that relatively complex movements are required to attach and detach the ornament from the frame member. This, of course, can be cumbersome in chandeliers having hundreds of delicate crystal ornaments that need to be mounted individually. Furthermore, the construction of such ornament shafts entails the formation of a complex, three-dimensional shape upon the end of the shaft, which shapes are more difficult and expensive to form than the two-dimensional shafts utilized with traditional ornament shaft designs. Finally, the frame members for such ornaments must be provided with precisely positioned holes for receiving the loop of the ornament shaft, which adds to the expense of the design and manufacture of the chandelier.

SUMMARY OF THE INVENTION

These and other drawbacks are overcome by the present invention which provides an ornament shaft that is easy to install and simple to manufacture, yet is resistant to dislodgement once assembled onto the chandelier frame.

The chandelier of the invention has a frame for supporting ornaments. The frame has a predetermined thickness and has a width defined between an inner edge and an outer edge. An ornament shaft terminating in a loop is attached to the frame. The loop has segments for engaging opposing width defining edges of the frame member while in a vertical hanging orientation. The ornament further has an opening defined by the shaft and a portion of the loop, the opening constructed and arranged so that the loop may be engaged with and disengaged from the frame member through the opening and only by first rotating the shaft substantially out of the vertical orientation. The ornament is further constructed and arranged such that substantially vertical displacement is prevented. Preferably the frame member includes a formation for accepting the loop in a manner so as to resist lateral movement of the loop upon the frame member. The formation may be defined by a portion of the frame member having a narrowed width relative to adjacent portions of the frame member. In one preferred embodiment of the ornament, the loop is substantially a circle extending from the shaft, the free end of the loop terminating at a preselected distance from the shaft to define with the shaft the opening.

BRIEF DESCRIPTION OF THE DRAWINGS

Other objects and advantages of the present invention will become more apparent with reference to the following detailed description and drawings in which.

DETAILED DESCRIPTION OF THE PREFERRED EMBODIMENTS

Figure 1:
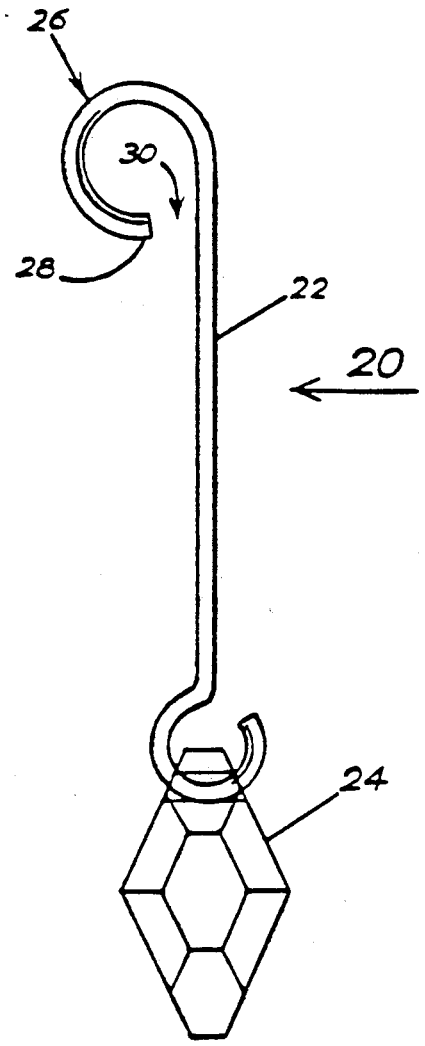
FIG. 1 is a side view of one embodiment of an ornament shaft according to this invention.

An ornament shaft according to this invention is illustrated in FIG. 1. The shaft 20 includes an elongated relatively straight segment 22 having an ornament structure 24 such as crystal, cut glass and the like at its bottom and a bent segment comprising a loop 26 at its top. The loop 26 of this embodiment is substantially coplanar with the rest of the straight segment 22. The straight segment 22 of the shaft 20 of FIG. 1 defines an axis and the loop 26 projects from that axis substantially circularly. The loop 26 terminates prior to contacting the straight segment 22. In this manner, an opening 30 is defined between the end 28 of the loop 26 and the straight segment 22 of the shaft 20. As will be described further below, this opening 30 permits engagement and disengagement of the loop 26 with the chandelier frame.

Ornament shafts, according to this embodiment, are formed generally from stainless steel or similarly rigid wire of conventional diameter. However, other shaft materials utilizing round and other compatible cross sections are contemplated according to this invention. The loop may be formed by bending of an otherwise straight end of the shaft around a mandrel or similar form that allows the quick shaping of a standard sized loop.

Figure 2:
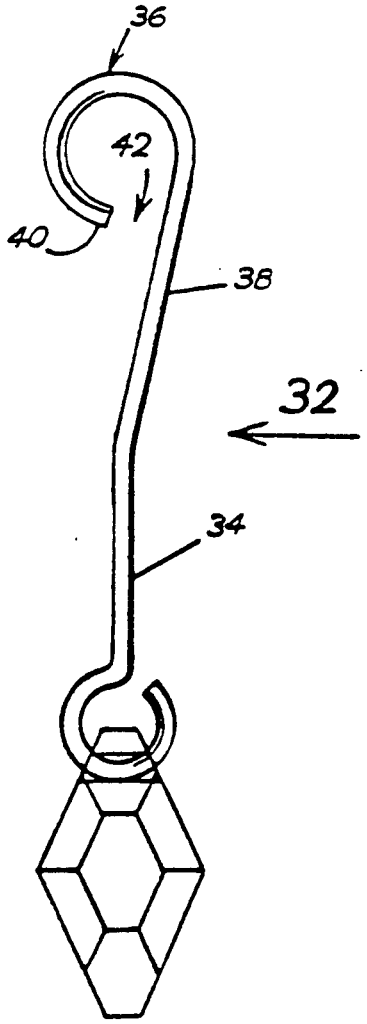
FIG. 2 is a side view of another embodiment of an ornament shaft according to this invention.

A second embodiment of an ornament shaft 32 according to this invention, as depicted in FIG. 2, is similar to the embodiment of FIG. 1, except that the "straight segment" is provided with a bend such that the circular loop is positioned directly above the ornament. In particular, the loop 36 and the ornament engaging straight segment 34 of the shaft 32 include therebetween a second straight segment 38, obtusely angled with respect to the ornament-engaging straight segment 34. The end 40 of the loop 36 then defines an opening 42 with respect to the second segment 38, rather than the ornament-engaging segment 34. Thus, when the loop 36 engages a frame, the straight (substantially vertically disposed) ornament engaging segment 34 of the shaft 32 is positioned directly below the center of the loop 36, not offset from the center of the loop as in the device of FIG. 1.

Figure 3:
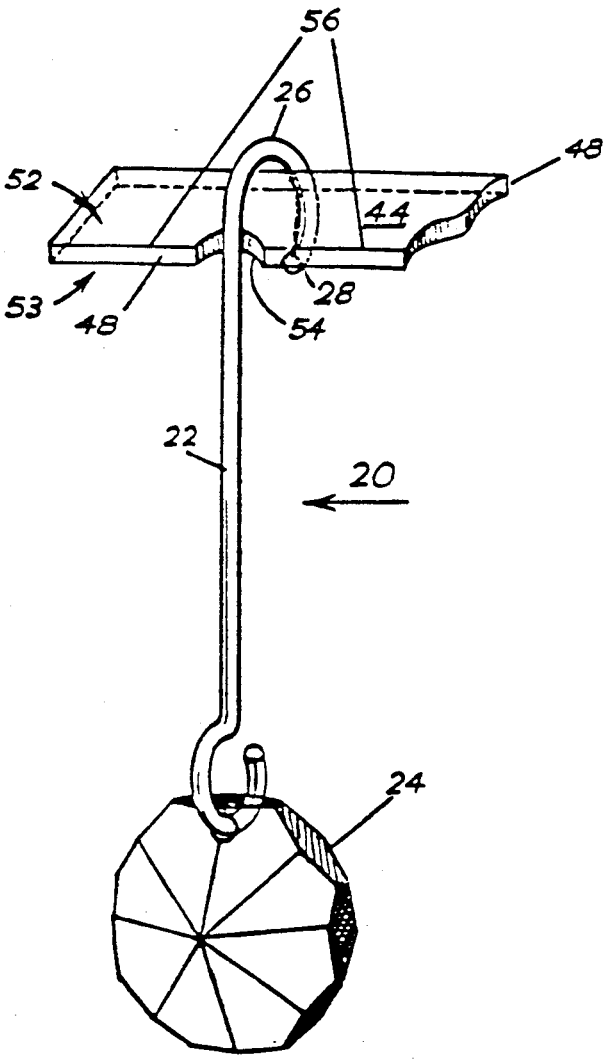
FIG. 3 is a perspective view of the interengagement of an ornament shaft and a frame member according to this invention.
Figure 4:
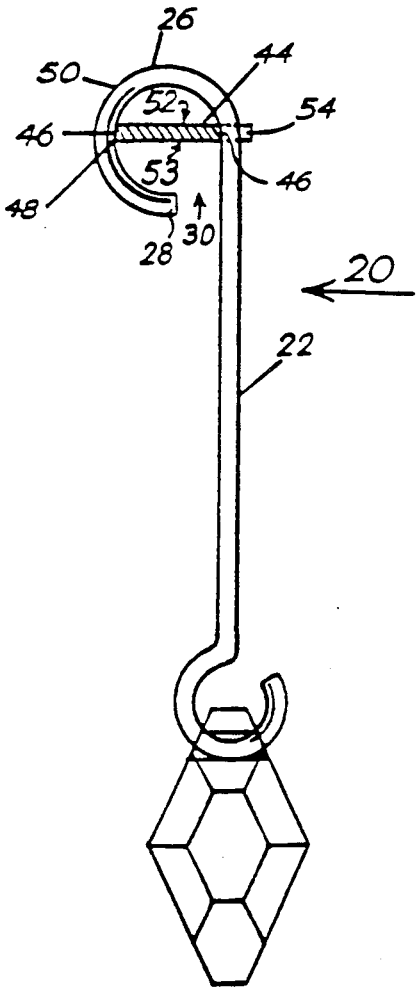
FIG. 4 is a side view of the ornament shaft and frame member of FIG. 3.

The engagement of an ornament shaft according to the invention with a chandelier frame member 44 is detailed in FIGS. 3 and 4. The shaft 20 appears in a normal vertical hanging-orientation. The loop's inner edges 46 are forced by the weight of the shaft and ornament into contact with corresponding width defining edges 48 of the frame member 44. The actual points of contact of the loop 26 with the frame 44 are determined by the relative diameter of the loop 26 and width of the frame member 44. Because the upper section 50 of the loop 26 narrows, further downward vertical displacement of the loop upon the frame member 44 is resisted. Because the end of the loop extends at least partially across the downwardly facing surface 52, upward vertical displacement is resisted.

The frame member 44 of this example is substantially rectangular in cross section. Other cross-sectional shapes are possible, but it is generally desirable to utilize a cross-sectional shape in which the thickness of the frame member (defined by the distance between surfaces 52, 53) is less than the width. In this manner, the end of the loop may define an opening that is less than the size of the width so that vertical dislodgement of the shaft from frame is resisted, but is greater than the size of the thickness to permit the frame to be passed into the loop (as will be described in greater detail below).

The frame member of this embodiment includes a dished formation or indent 54 along one width defining edge 48 that decreases the width locally along a limited lengthwise section of the frame member 44. While it is possible to utilize unindented constant cross-section frame members according to this invention, the use of an indent 54 provides a number of advantages, including precisely positioning the ornament with respect to the frame. It is thus important that the inner diameter defined by the loop 26 is not substantially greater than the width of frame member sections 56 adjacent the indented section. Otherwise, lateral displacement by, for example jarring of the frame, might cause the loop to "jump" from its designated position onto another lengthwise section of the frame member 44.

As depicted in FIG. 4, the preferred loop 26 is sized so that its inner diameter at all points substantially matches the width of the indented portion of the frame member 44. As such, displacement of the loop 26 in a widthwise direction (Arrow A) is restricted. The end portion 28 of the loop also serves to restrict substantially vertical displacement (Arrow B) of the loop 26 relative to the frame member 44. Because the inner diameter of the preferred loop is sized to substantially match the narrowed width of the indent 54, lengthwise lateral movement (i.e. displacement in a direction transverse to its width, Arrow C) is restricted. The loop 26 simply is not large enough to accommodate those portions of the frame that are not indented.

Security of attachment of the shafts to the frame member according to the above embodiment is particularly enhanced because the ornaments naturally tend to hang substantially vertically due to the weight of the ornament at the end of each shaft. In this vertical position, as depicted in FIGS. 3-4, the loop 26 completely restricts vertical and lateral dislocation of the shaft 20 relative to the frame member 44. Only rotation of the loop 26 about the frame member 44 is permitted, and the weight of the ornament 24 stabilizes the loop rotationally in absence of an externally applied rotational force.

Figure 5:
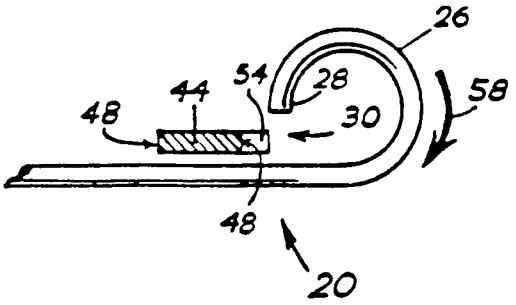
FIGS. 5–7 are side views illustrating the attachment of the ornament shaft to the frame member of FIG. 3.
Figure 6:
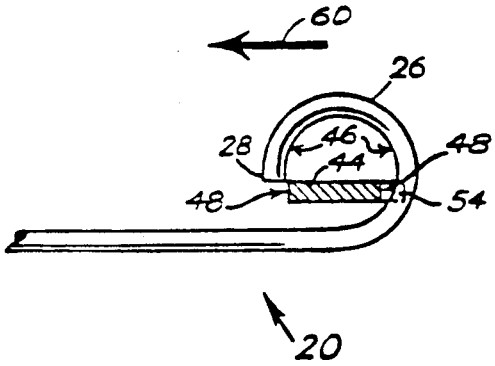
Figure 7:
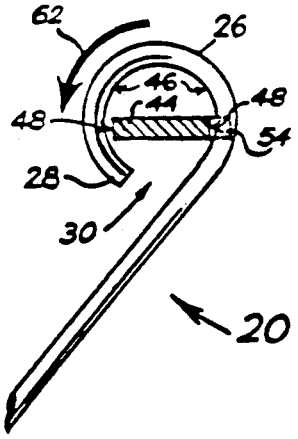

The opening in the loop, as noted, permits the engagement and disengagement of the shaft from the frame member. The sequence of engaging a loop 26 to the frame member 44 of FIGS. 3-4 is illustrated in FIGS. 5-7. The shaft 20 is first rotated (arrow 58, FIG. 5) so that the opening 30 is proximate a width defining edge 48 of the frame member and the straight segment 22 of the shaft 20 adjacent the loop is placed in a non vertical, engagement orientation. In this example, the shaft 20 must be rotated about 90 degrees out of its vertical hanging position to obtain the proper engagement orientation. After the shaft 20 is rotated, it is moved in the direction of arrow 60, FIG. 6, so that the frame member 44 passes through the opening 30. Thus, a combination of rotation and linear translation serves to place the frame member 44 completely within the bounds of the loop 26, such that opposing inner edges 46 of the loop 26 surround the frame member 44. At this time, the loop 26 and shaft 20 may be rotated in the direction of arrow 62, FIG. 7, back to a vertical hanging orientation. The frame member 44 is, thus, captured by the loop 26, as depicted in FIGS. 3 and 4, incapable of being removed therefrom simply through substantially vertical displacement. Gravity tends to further stabilize to ornament 24 in a vertical hanging orientation. As such, disengagement may only occur by manually undertaking, in a reverse order, the steps shown in FIGS. 5-7, i.e., rotation of the loop 26 back to a non-vertical position and linear translation of the frame member 44 through the opening 30.

It is important to note that the loop 26 must be shaped to allow rotation of the frame member 44 positioned therein. In other words, a linear spacing of opposing inner edges 46 of the loop 26 must be set so that the spacing remains greater than or equal to the frame member 44 width at a mounting location throughout a rotational path of the loop 26. However, since the shaft material is generally somewhat resilient, the spacing between its inner edges may in fact be lightly less than the width of the frame member since the loop mayl expand as it is rotated, but the spacing should not be so small as to result in undesired plastic deformation of the lop as it is rotated.

The particular sizing and shape of the loop in combination with both the size of the opening and the positioning of the straight segment adjacent the loop determines the angle of rotation from vertical to non-vertical orientation required to pass a given thickness frame member through the opening. Thus, where all other dimensions are constant, a larger opening allows a smaller angle of rotation from vertical orientation in order to slide the frame member through the opening.

While the loop and frame member assembly of FIGS. 3-7 shows attachment of the shaft 20 by sliding the indent 54 edge of the frame member 44 through the opening 30 first, it is equally possible to slide the opposing non-indent edge of the frame member 44 through first. The disadvantage of such an approach in the FIG. 3-4 embodiment is that the straight shaft segment 22 retains some degree of lengthwise displacability relative to the frame member 44 while the opposing loop segment is fixed, forming an axis of rotation for the opposing straight segment 22 to swing through an arcuate path. For greatest chandelier precision, therefore, the straight segment 22 should be supported in the indent 54 giving it the greatest degree of lengthwise lateral restraint.

Figure 8:
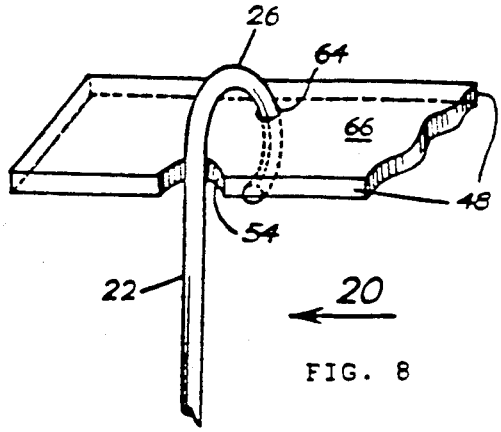
FIG. 8 is a perspective view of another embodiment of an ornament shaft and frame member according to this invention.
Figure 9:
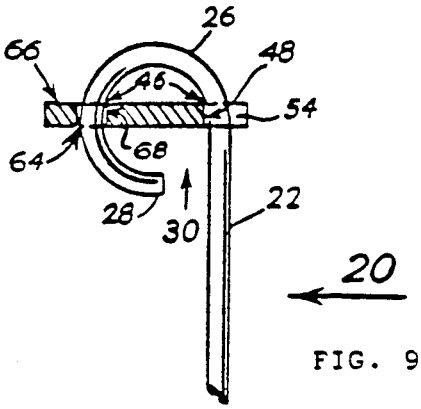
FIG. 9 is a side view of the ornament shaft and frame member of FIG. 8.

A greater degree of lateral restraint for both the straight segment 22 and loop 26 of a vertically hanging shaft 20 is provided in the frame member embodiment of FIGS. 8-9. This embodiment shows the use of a conventional hole 64 through the non-width defining faces of the frame member 66 in combination with at least one indentation. A loop 26 according to the embodiment of FIG. 1 is depicted, but, as with all frame member embodiments shown herein, a loop 36 according to FIG. 2 or other rotationally attached/detached loop structure may be utilized according to this invention. As illustrated in FIG. 9, the loop's inner edges 46 engage opposing width defining edges 48, 68 respectively of each of the indent and hole. Attachment of the loop 26 is similar to the sequence shown in FIGS. 5-7, but must be performed by sliding the indent 54 side of the frame member 66 first through the opening 30. The loop end 28 is then brought into position over the hole 64. Once positioned over the hole 64, the loop is then rotated so as to pass the end 28 through the hole 64 and to place the shaft 20 in a vertical hanging orientation (as shown in FIG. 9). The end 28, according to this embodiment, must be designed to align with and pass through the hole 64 upon rotation. Similarly, the hole 64 must be large enough to accommodate the curvature of the loop end 28 as it passes therethrough during rotation.

The holes utilized in the frame member 66 of this embodiment may be constructed using a punch in a relatively rapid manner. However, unlike more conventional designs which either involve a complex series of movements in order to place the ornament through the hole 64, or which simply dangle an easily vertically displaceable U-shaped hook through the hole, this system completely restrains the ornament shaft in all degrees of freedom except rotation which is the most weight-stabilized degree. The shaft 20 is, thus, restrained positively by the weight of the ornament 24, but may be engaged or disengaged easily by hand using a rapid rotational and sliding movement.

Figure 10:
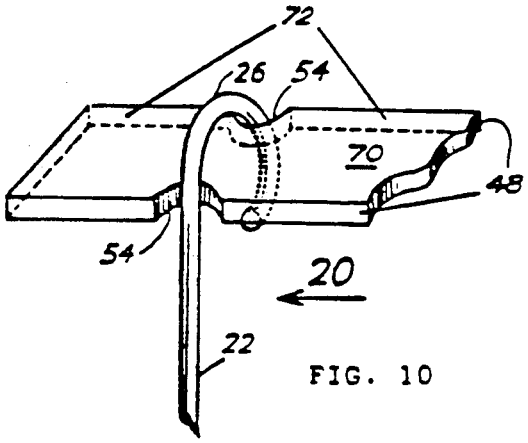
FIG. 10 is yet another embodiment of an ornament shaft and frame member according to this invention.

A particularly preferred frame member and shaft arrangement is shown in FIG. 10. The frame member 70 in this embodiment is easier to manufacture than the frame member 66 of FIG. 8, since it does not entail the use of holes, and, rather, involves only the formation of indents 54 along opposing width defining edges 48. As such this embodiment is preferred, especially in instances when the frame is fabricated by laser cutting. The raw material sheet may be positioned in a cutter and quickly formed using, almost entirely, edge cuts via a preprogrammed table of instructions. The cut frame member may then be output for assembly to the frame without further drilling or welding since all structures for securely holding shafts thereto are already formed directly upon the frame member. Furthermore, such a frame member 70 facilitates even quicker mounting of ornaments since the installer need not attempt to locate a relatively small hole through which to thread a loop end. Rather the installer need only slip the opening 30 of the loop onto the frame at a pair of opposed indents and rotate the loop into position in a manner described in FIGS. 5-7. The result is a secure attachment using a frame member and shaft that both are easy to manufacture.

Figure 11:
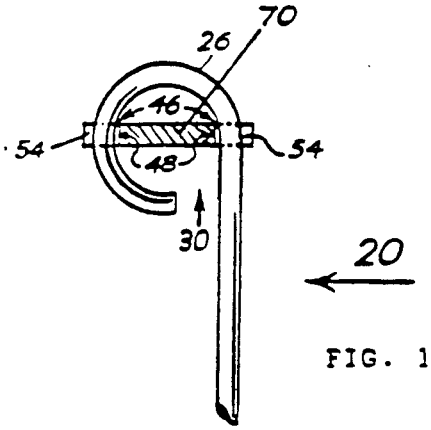
FIG. 11 is a side view of the ornament shaft and frame member of FIG. 10.

As depicted in FIG. 11, the opposing indents 54 prevent substantial lengthwise lateral movement of each opposing engaging loop segment in a vertical hanging orientation. The spacing of inner edges 46 of the loop 26 at the engaging segments should be sized to be less than the width of adjacent non-indented frame member sections 72. The frame member 70, due to its opposing indents 54, provides the additional advantage of allowing mounting of an ornament-supporting straight segment of the shaft proximate either edge of the frame member with equal lengthwise lateral stabilization.

Figure 12:
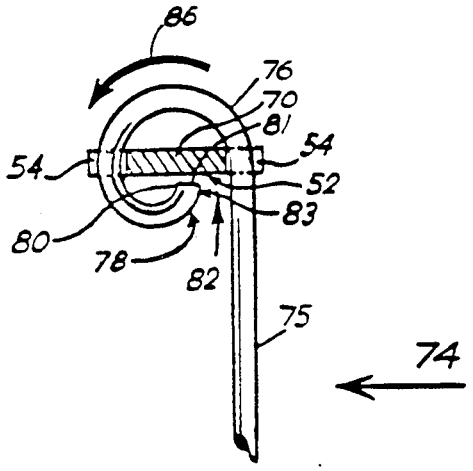
FIG. 12 is a side view of another embodiment of an ornament shaft utilized with the frame member of FIG. 10.

The free end of the loop according to this invention need not always be positioned in direct opposition to the straight segment of the shaft. An alternative embodiment of a shaft 74 having a loop 76 with a multi bend loop end segment 78 is depicted in FIG. 12. While the loop 76 shown is attached to a frame member 70 of the embodiment of FIGS. 10-11, other frame member styles, including a non-indented frame member may be used in accordance with this embodiment. The free end 80 of the loop 76 is not positioned in direct opposition to the straight segment 75 of the shaft, but, rather, is positioned in direct opposition to the bottom surface 52 of the frame member 70 so that the tip 81 of the free end 80 comes into interfering contact with the bottom surface 52 in the event of upward vertical displacement of the shaft. The multi-bend end segment 78, as a whole, still defines an opening 82 through which the frame member 70 may pass when the shaft 74 is first rotated into a non-vertical orientation. In this case, the thickness of the frame member passes between the straight segment and the curved side edge 83 of the end segment 78 during engagement and disengagement of the shaft 74 and frame member 70. The step of rotation to engage (arrow 85) and to disengage (arrow 86), however, occurs in an opposite direction than that encountered for a loop end 28 of the type depicted in FIGS. 5-7.

Figure 13:
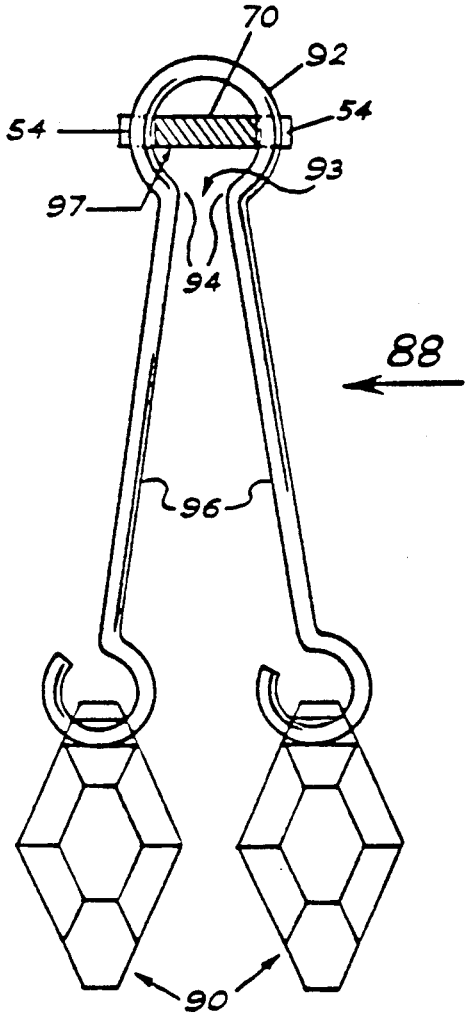
FIG. 13 is a side view of yet another embodiment of an ornament shaft utilized with the frame member of FIG. 10.
Figure 14:
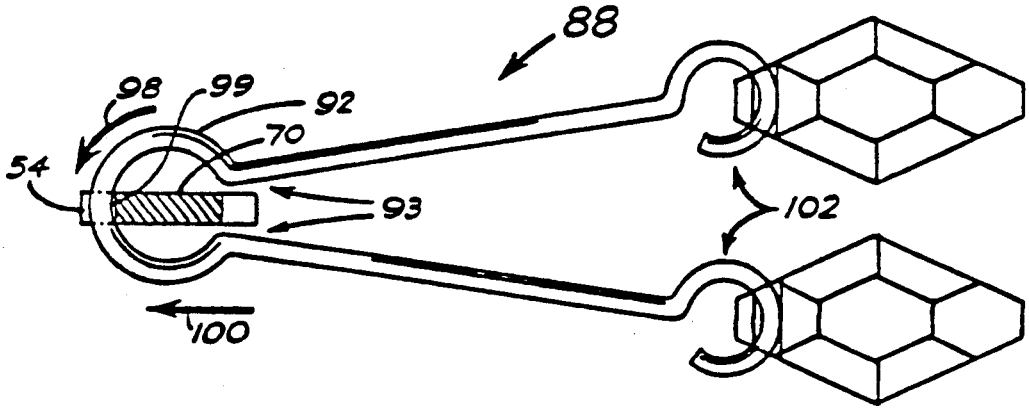
FIG. 14 is a side view illustrating detachment of the ornament shaft of FIG. 13 from the frame member.

A rotationally attachable and detachable ornament shaft 88 for supporting ornaments 90 is depticted in FIGS. 13 and 14. Like the above described preferred embodiments, the shaft includes a loop 92 constructed and arranged to closely engage with defining edges of the frame member 70 within opposing indents 54. Unlike the above described embodiments, there are two straight segments extending from opposing ends of the loop 92 so that two ornaments may be supported by a single hook. This reduces manufacturing cost and facilitates assembly of the chandelier, as the placement of a single loop results in the attachment of two ornaments. As described in greater detail below, it also permits a variety of novel ornament arrangements.

The shaft 88 of this embodiment has two shaft segments 96 extending from opposing ends of the loop 92. A pair of joints 94 are defined by the junction of the straight segments 96 and the opposing ends of the loop 92. The opening 93 to the loop 92 is defined by the distance between the two joints 94, which distance is less than the width of the frame member 70 at the indents 54, but is greater than or equal to the thickness of the frame member 70.

In the embodiment depicted in FIG. 13, the two straight shaft segments 96 hang substantially vertically from the frame member 70. By substantially vertically it is meant that the segments 96 define an axis that is substantially perpendicular to the plane defined by the bottom surface 97 of the frame member 70. The weight of each of the ornaments 90, if equal, will tend to balance the ornaments with respect to one another and maintain the shaft in a substantially vertical hanging orientation. Ornaments of unequal weight would tend to cause some rotation of the loop and a change in the vertical positioning of the ornaments with respect to one another. The relative weight of the ornaments becomes increasingly important as the distance or spread between the ornaments increases.

Like previous embodiments described herein, the loop 92, when engaged with the frame member 70, is free to rotate as depicted by arrow 98 in FIG. 14. When the opening 93 is aligned with the width defining edges of the frame member, the shaft 88 may be moved (arrow 100) out of engagement with the frame member 70. To complete disengagement of the shaft 88 from the frame member 70, the frame member 70 is passed through the space 102 between the two ornaments 90. Similarly, to reengage the shaft 88 with the frame member 70, the frame member is passed through the space 102 between the ornaments 90 while the shaft is in a rotated position as depicted in FIG. 14. The frame member 70 then is passed through the opening 93 in the loop 92 until the apex 99 of loop contacts a width defining edge of the frame member indent 54. The loop 92 then may be rotated in a direction opposite the arrow 98 back to a vertical hanging position.

The use of ornaments 90 upon opposing shaft segments 96 according to this embodiment increases the variety of possible ornament designs. Moreover, ease of ornament attachment and detachment according to this embodiment is in general, no more difficult an or single ornament shafts since the same rotational and sliding movements are employed.

Figure 15:
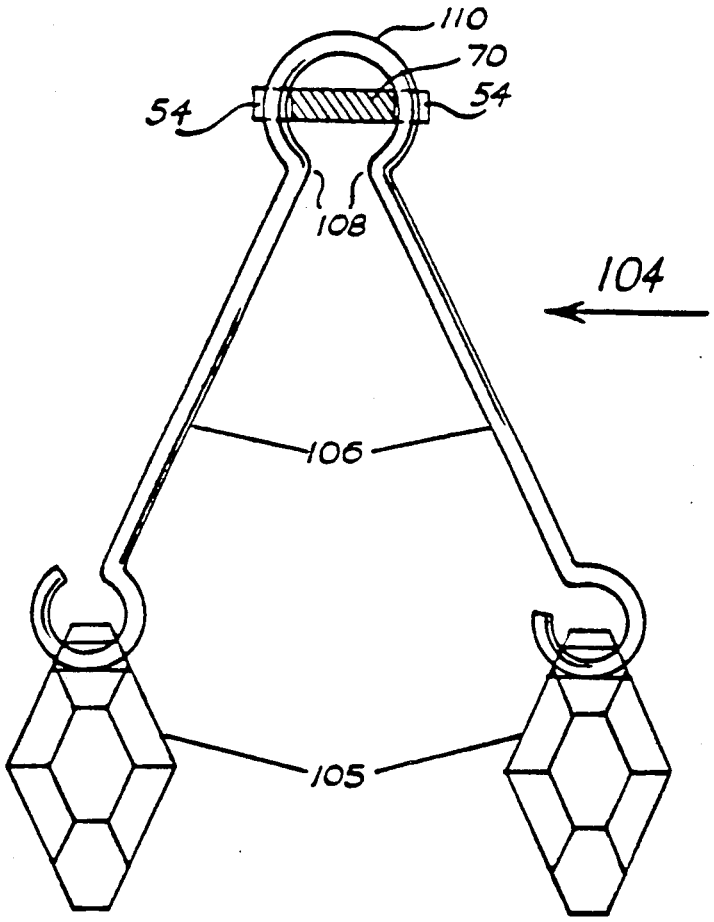
FIG. 15 is a side view of another embodiment of the ornament shaft of FIG. 13 showing a wider spread between opposing ornaments.

The distance between ornaments according to this embodiment may be increased by angling each of the straight shaft segments further away from each other. FIG. 15 illustrates an ornament shaft 104 having relatively widely spaced ornaments 105. The distance between the ornaments in this embodiment is greater than the width of the frame member 70.

The ornaments 105 are supported by substantially straight shaft segments 106 that project at an angle with respect to one another from their joints 108 with the shaft loop 110. For the purposes of this discription, the shaft 104 is considered as positioned in a substantially vertical hanging orientation. Thus, although the straight segments 106 are angled relative to one another, they are symetrical about an axis that is perpendicular to the plane defined by the bottom surface of the frame member. Upward displacement of the shaft 104 from the frame member by movement along this axis is prevented by engagement of the joints 108 with the bottom surface of the frame member 70.

While each of the shafts of FIGS. 13-15 depict roughly equal size ornaments and equal length straight shaft segments projecting at equal opposing angles from each other, may other configurations will be apparent to those of ordinary skill in the art. For example, one of the straight segments may be shorter than the other to produce a tiered effect between opposing ornaments. Furthermore, the ornaments may be weighted differently so as to cause the loop to be rotated somewhat from the orientation shown in the figures to result in a tiered arrangement. The loop, however, should remain rotationally positioned such that substantially vertical displacement is restricted by the end (joint) portions of the loop proximate the opening.

More complex loop end segments are contemplated according to this invention. It is important, however, that the overall end segment generally define an opening relative to an opposing shaft segment through which the frame member may pass, and that the loop, including its end segment, is sized to allow rotation of the frame member back to a vertical orientation once the frame member is fully enclosed by the loop. Of course, the loop should be further sized to prevent substantially vertical dislodgement in a substantially vertical orientation.

Figure 16:
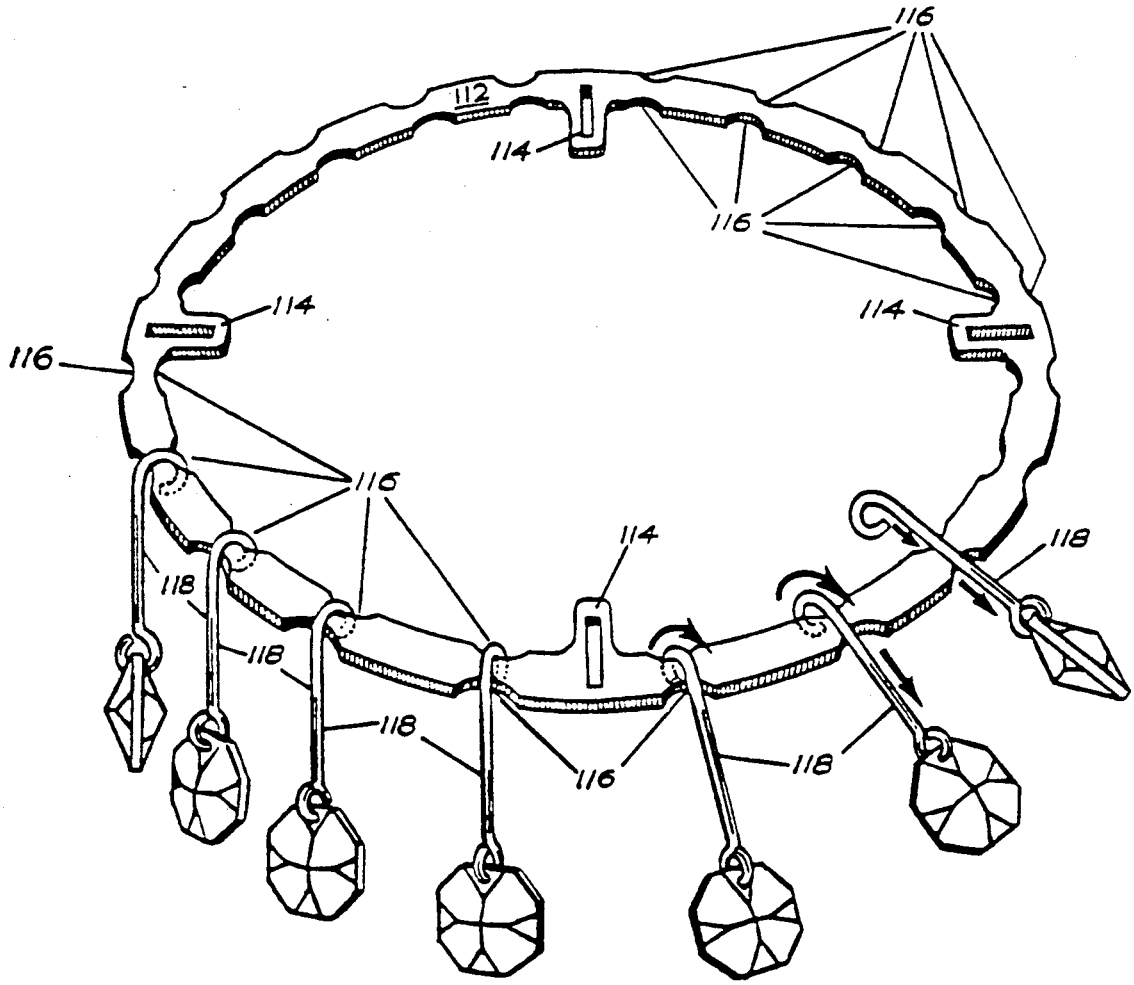
FIG. 16 is a perspective view of a ring-shaped frame member having undulating formations with ornaments at various stages of mounting thereon.

Elaborate frame and ornament arrangements are possible according to this invention. FIG. 16 illustrates a ring-shaped frame member 112 having lugs 114 for attachment to other chandelier members (not shown). Such a ring 112 may be constructed using laser cutting or punch techniques on flat sheet metal such a stainless steel to obtain a substantially non stressed ring. The cutting according to this embodiment includes the formation of a plurality of undulating indents 116. The undulating shape not only endows the ring 112 with pleasing aesthetic characteristics, but allows precise positioning of ornament shafts 118. The shafts 118 are stable vertically and laterally, but as described, may be attached with relative ease using a combined sliding and rotational motion. As noted, this attachment technique is relatively easy to perform and, thus, assembly and removal of large numbers of shafts proceeds quickly, even upon chandeliers located in relatively difficult to access locations. An added advantage, particularly welcome while working in somewhat inaccessible locations, is that the indents 116 are easy to see or feel, further expediting positioning of the shaft loop thereon.

Any of the frame member embodiments shown variously herein may be utilized in a repeating pattern upon the ring. Despite the largeness of the dished indents 116, the loops become self-centered accurately within the narrowest width section of each indentation due to the opposing narrowing of each loop's upper half.

It should be understood that the preceding is merely a detailed description of the preferred embodiments. It should be apparent to those skilled in the art that various modifications and equivalents can be made without departing from the spirit and scope of the invention.

The preceding description is meant to be taken only by way of example and to describe only a preferred embodiment and not to limit the scope of the invention.

What is claimed is:

1. A chandelier having a frame for supporting ornaments having shafts attached thereto with increased security comprising:

a frame member having predetermined thickness and width between an inner edge and an outer edge, the width being greater than the thickness and the width having a horizontal hanging orientation; and an ornament shaft secured to the frame member and terminating in a lop having segments for engaging the width defining edges of the frame member while in a substantially vertical hanging orientation and further having an opening defined by the shaft and a portion of the loop, constructed and arranged so that the loop may be engaged with and disengaged from the frame member only through the opening and only by first rotating the shaft substantially out of the substantially vertical hanging orientation and further constructed and arranged such that substantially vertical displacement is prevented.

2. A chandelier as set forth in claim 1 wherein the loop is coplanar.

3. A chandelier as set forth in claim 1 wherein the opening defines a width that is greater than or substantially equal to the thickness of the frame member, whereby the frame member is engaged with and disengaged from the loop through the opening only by rotating the shaft to a limited range of angles.

4. A chandelier as set forth in claims 1, 2 or 3 wherein a portion of the shaft proximate the ornament is substantially straight and the loop extends therefrom.

5. A chandelier as set forth in claim 4 wherein the opening is defined by the straight shaft portion and an end of the loop.

6. A chandelier as set forth in claim 5 wherein an end portion of the loop is disposed to interfere with a non width defining surface of the frame member when the shaft is positioned in the vertical hanging orientation.

7. A chandelier as set forth in claim 6 wherein the opening is defined by an end of the loop and a portion of the loop extending at an obtuse angle from the straight portion.

8. A chandelier as set forth in claims 1, 2 or 3 wherein an end of the loop is disposed to interfere with a surface of the frame member when the shaft is positioned in the substantially vertical orientation, thereby preventing substantially vertical dislodgement of the shaft from the frame member.

9. A chandelier as set forth in claims 1, 2 or 3 further comprising a formation upon the frame member for engaging the loop, the formation defining one edge of a frame member width that is narrower than that from the inner edge to the outer edge of adjacent sections of the frame member, thereby resisting lateral movement of the shaft along the frame member.

10. A chandelier as set forth in claim 9 wherein the inner diameter of the loop is greater than or equal to the narrower, frame member width defined by the formation and is less than the width from the inner edge to the outer edge of sections of the frame member adjacent to the formation.

11. A chandelier as set forth in claim 10 wherein the formation comprises a recess along at least one of the inner edge and the outer edge of the frame member.

12. A chandelier as set forth in claim 10 wherein the formation comprises a pair of opposing recesses, one along the inner edge and one along the outer edge of the frame member.

13. A chandelier as set forth in claim 12 wherein the opposing formations each comprise a curved recess.

14. A chandelier as set forth in claim 13 wherein the frame member comprises a ring and the formations comprise a repeating undulative pattern thereon.

15. A chandelier as set forth in claim 14 wherein the opening is defined by the straight shaft portion and an end of the loop.

16. A chandelier as set forth in claim 9 further comprising a hole upon the frame member through the thickness, opposite the formation, a portion of the hole defining an edge for engaging a segment of the loop.

17. A chandelier as set forth in any of claims 1, 2 or 3 wherein the opening is defined by joints between the loop and each of a pair of opposing ornament supporting shaft segments projecting from the loop in a substantially similar direction.

18. A chandelier as set forth in claim 17 wherein at least one of the ornament supporting shaft segments is straight between an ornament and corresponding joint with the loop.

19. A chandelier as set forth in claim 11 wherein the opening is defined by joints between the loop and each of a pair of opposing ornament supporting shaft segments projecting from the loop thereto in a substantially similar direction.

20. A chandelier as set forth in claim 19 wherein at least one of the ornament supporting shaft segments is straight between an ornament and a corresponding joint with the loop.

* * * * *

UNITED STATES PATENT AND TRADEMARK OFFICE

CERTIFICATE OF CORRECTION

PATENT NO. : 5,116,009

DATED : MAY 26, 1992

INVENTOR(S) : GEORG BAYER

It is certified that error appears in the above-identified patent and that said Letters Patent is hereby corrected as shown below:

In claim 1, column 9, line 14, please change "lop" to --loop--.

Signed and Sealed this

Twenty-sixth Day of July, 1994

Bruce Lehman

*Attest:*

BRUCE LEHMAN

*Attesting Officer*

*Commissioner of Patents and Trademarks*